US007387548B2

(12) United States Patent
Takehara et al.

(10) Patent No.: US 7,387,548 B2
(45) Date of Patent: Jun. 17, 2008

(54) ELECTRIC CONTACT AND FEMALE TERMINAL

(75) Inventors: Hideaki Takehara, Hitachi (JP); Naofumi Chiwata, Mito (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 11/603,994

(22) Filed: Nov. 24, 2006

(65) Prior Publication Data

US 2007/0123084 A1 May 31, 2007

(30) Foreign Application Priority Data

Nov. 25, 2005 (JP) ..... 2005-340501
Apr. 19, 2006 (JP) ..... 2006-115994

(51) Int. Cl.
*H01R 13/33* (2006.01)

(52) U.S. Cl. ..... 439/843; 439/851; 439/856

(58) Field of Classification Search ..... 439/843, 439/857, 856, 851, 748
See application file for complete search history.

(56) References Cited

U.S. PATENT DOCUMENTS

| | | | | |
|---|---|---|---|---|
| 2,476,886 | A * | 7/1949 | Miller et al. | 439/830 |
| 2,740,735 | A * | 4/1956 | Swain | 148/532 |
| 4,550,972 | A * | 11/1985 | Romak | 439/839 |
| 4,720,157 | A * | 1/1988 | Nestor et al. | 439/851 |
| 4,818,634 | A * | 4/1989 | Bliss | 428/677 |
| 5,078,622 | A | 1/1992 | Hunt, III et al. | |
| 5,083,927 | A * | 1/1992 | Herard et al. | 439/80 |
| 5,088,942 | A * | 2/1992 | Welsh et al. | 439/843 |
| 5,533,914 | A * | 7/1996 | Sawada | 439/843 |
| 6,062,919 | A * | 5/2000 | Trafton | 439/843 |
| 6,520,998 | B1 * | 2/2003 | Scholler et al. | 439/851 |
| 6,656,002 | B2 * | 12/2003 | Zhao et al. | 439/851 |
| 7,115,003 | B2 * | 10/2006 | Zhao et al. | 439/851 |
| 7,115,004 | B2 * | 10/2006 | Takayama | 439/852 |

FOREIGN PATENT DOCUMENTS

| | | |
|---|---|---|
| JP | 03-004467 | 1/1991 |
| JP | 07-192794 | 7/1995 |
| JP | 07-263061 | 10/1995 |
| JP | 07-296871 | 11/1995 |
| JP | 08-031488 | 2/1996 |
| JP | 08-222314 | 8/1996 |
| JP | 2000-091013 | 3/2000 |
| JP | 2001-060481 | 3/2001 |

* cited by examiner

*Primary Examiner*—Renee S Luebke
*Assistant Examiner*—Harshad C Patel
(74) *Attorney, Agent, or Firm*—Antonelli, Terry, Stout & Kraus, LLP.

(57) ABSTRACT

An electric contact and a female terminal have high spring elasticity and high electric conductivity. In the electric contact 1 arranged inside the female contact maker 11, the contact member 2 in an approximately cylindrical shape is formed by the composite member composed of the electric conductive member 3 and the spring member 4.

18 Claims, 3 Drawing Sheets

ELECTRIC CONTACT AND FEMALE TERMINAL

BACKGROUND OF THE INVENTION

The present invention relates to an electric contact and a female terminal arranged inside the female contact maker in which the male contact maker is inserted.

There is such an electric connector for carrying a high current over 100A that an electric connection is established between the female contact maker and the male contact maker by an electric contact having multiple contact makers configured as multiple springs shaped in a cylinder arranged inside the female contact maker.

For example, a typical connector 51, as shown in FIG. 5A and FIG. 5B comprises a male contact maker 52, an electric contact 54. formed as a cylindrical shape and arranged inside the female contact maker 52, for accepting the male contact maker 52 inside itself. The electric contact 54 is used so that the electric contact 54 may be placed between the male contact maker 53 and the female contact maker 52. The conventional contact 54 is composed of a single material and its material is selected by considering both the spring elasticity and the electric conductivity.

As the technical references related to the present invention, there are Japanese Patent Laid-Open No. 7-192794 (1995) and Japanese Patent Laid-Open No. 8-31488 (1996).

SUMMARY OF THE INVENTION

However, any means is required for reducing the heat generation and the arc discharge when carrying the current, and in case that those phenomena occur, there may be such bad influences that the case of the connector melts down and that the thermal effect transfers to the environment components.

In the prior art, the contact resistant is required to be reduced by applying a large force between the male contact maker 53 and the female contact maker 52 by way of spring force of the electric contact 54 in order to carry the high current, and a material having a high electric conductivity is required to be used for reducing the heat generation of the electric contact 54 itself.

As for the conventional material used for the contacting components, a material providing both the higher spring elasticity and the higher electric conductivity is typically used such as phosphor bronze and beryllium copper. However, those materials have an electric conductivity lower than approximately 50% IACS, and require a larger volume for the electric contact 54 for carrying the high current, which results in a limit in downsizing the components.

An object of the present invention is to provide an electric contact and a female contact maker having the higher spring elasticity and the higher electric conductivity for carrying the high current.

To achieve the above object, the invention includes an electric contact arranged Inside a female contact maker, in which the contact member is formed by a composite material composed of the electric conductive member and the spring member.

In another aspect of the invention, the above composite member is formed by laminating the electric conductive member shaped in a plate and the spring member shaped in a plate and then, the composite member is reformed in an approximately cylindrical shape in order to obtain the above contact member.

In another aspect of the invention, the above composite member is toned by laminating both faces of the spring member shaped in a plate by the electric conductive member shaped in a plate, and then, the composite member is reformed in an approximately cylindrical shape in order to obtain the above contact member.

In another aspect of the invention, the above electric conductive member is composed of copper or copper base alloy, and the above spring member Is composed of stainless steel, phosphor bronze, beryllium copper or Corson alloy.

In another aspect of the invention, the above electric conductive member is formed as an inside wall, the above spring member is formed as an outside wall, an outside contact section is formed as the above electric conductive member connected to the above inside wall and located outside the outside wall.

In another aspect of the invention, the above outside contact section is formed outside in the radial direction of the end part of the above outside wall.

In another aspect of the invention, the above outside contact section is formed by folding back the end part of the above inside wall toward outside the end part of the above outside wall.

In another aspect of the invention, the outside contact section is formed by folding back both end parts of the above inside wall toward outside the individual end parts of the above outside wall.

In another aspect of the invention, the outside contact section is formed by folding back the end part of the above inside wall and the end part of the above outside wall toward outside.

Another aspect of the invention is a female terminal in which a female contact maker having an open part for inserting a male contact maker and a contact housing space for connecting to the open part is formed, and an electric contact described above is accommodated inside the contact housing space of the female contact maker.

Another aspect of the invention is a female terminal in which a female contact maker having an open part for inserting a male contact maker and a contact housing space for connecting to the open part is formed, an electric contact described above is accommodated Inside the contact housing space of the female contact maker, and the outside contact section Is connected to the inside circumference of the contact housing space.

According to the present invention, it will be appreciated that the spring elasticity characteristic and the electric conductivity characteristic can be controlled individually which cannot be attained by using a single material. As a result, more stable electrical connection can be secured between the male contact maker and the female contact maker in order to carry the high current.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DETAILED DESCRIPTION OF THE PREFERRED EMBODIMENTS

By referring to attached drawings, the best mode for embedding the present invention is described.

Figure 1A:
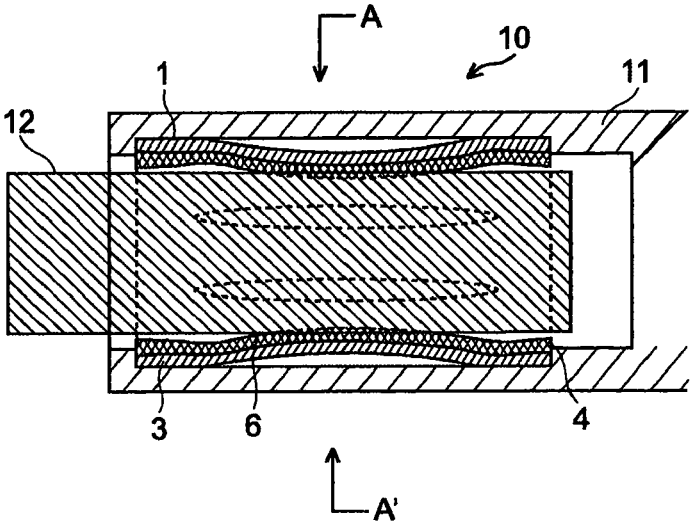
FIG. 1A is a cross-section view of the connector in one embodiment of the present invention.
Figure 1B:
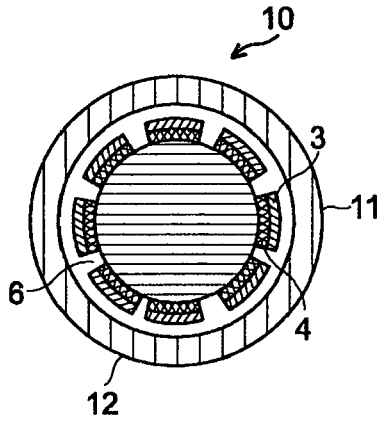
FIG. 1B is a cross-section view taken along line A-A' of FIG. 1A.
Figure 2:
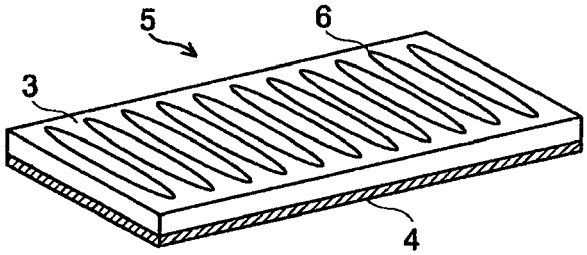
FIG. 2 is a perspective view of the unfolded electric contact shown in FIG. 1

FIG. 1A is a section of the connector and FIG. 1B is a section taken along line A-A' of FIG. 1A, both representing the best mode for embedding the present invention. FIG. 2 is a perspective view of the unfolded electric contact shown in FIG. 1A and FIG. 1B, FIG. 3 is a folded structure of the electric contact, and FIG. 4 is a perspective view of the connector shown in FIG. 1A and FIG. 1B.

As shown in FIGS. 1A, 1B, 3 and 4, the electric contact 1 used for connectors in this embodiment is formed in an approximately cylindrical shape and arranged inside the female contact maker formed in a cylindrical shape so as to accept the male contact maker 12 formed in a rod shape at the inside circumference of the electric contact in order to connect the electric wires together, in which the contact member 2 formed in an approximately cylindrical shape is formed with the composite member composed of the electric conductive member 3 and the spring member 4.

The electric contact 1 is used at the form in which the electric contact 1 is inserted between the female contact maker 11 and the male contact maker 12. As the structure of the female contact maker 11 and the male contact maker 12 is the same as the conventional structure is, its detail structure is not described here.

Figure 3:
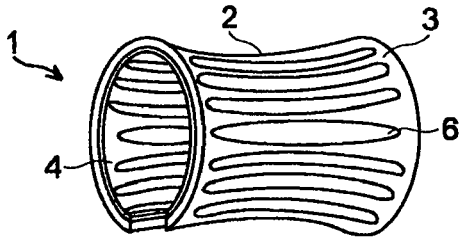
FIG. 3 is an installation configuration of the electric contact shown in FIG. 1.
Figure 4:
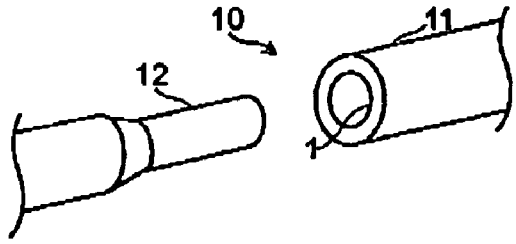
FIG. 4 is a perspective view of the connector shown in FIG. 1.

As shown in FIG. 2, the electric contact 1 is formed in the following way; at first, the composite member (clad material) S is formed by laminating the electric conductive member 3 shaped in a plate and the spring member 4 shaped in a plate, then a plurality of long holes (slits) 6 are formed in the direction vertical to the longitudinal direction of the composite member 5 at a regular interval in the longitudinal direction of the composite member 5, and next the composite member 5 is relied in the longitudinal direction of the composite member 5 so that the spring member 4 may be located inside the inside circumference of the finished cylinder in order to finish the contact member 2 in an approximately cylIndrical shape as shown in FIG. 3. The holes or slits 6 can have a long rectangular shape. More specifically, the contact member is formed in an approximately cylindrical shape so that the center section of the cylinder in its longitudinal direction may have a relatively small diameter and an elastic force may be generated in the direction to the outside circumference.

Figure 5A:
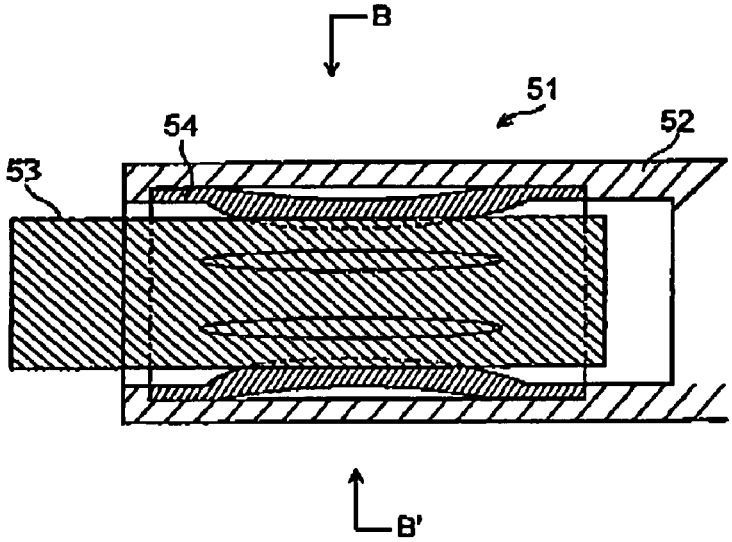
FIG. 5A is a cross-section view of the conventional connector and FIG. 5B is a cross-section view taken along line B-B' of FIG. 5A.
Figure 5B:
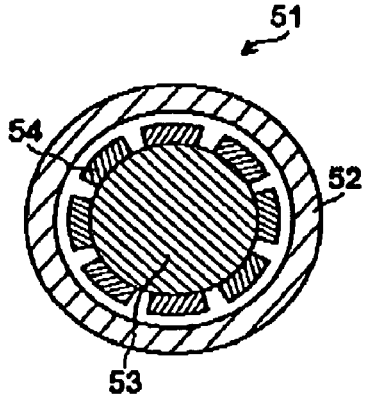

In the example shown in FIG. 2, the composite member 5 is formed so that the thickness of the electric conductive member 3 is larger than the thickness of the spring member 4. In this case of the electric contact 1, its electric conductivity can be increased to a large extent while the spring elasticity may not be sacrificed in comparison with the conventional electric contact 54 shown in FIG. 5.

As for the production method for the electric contact 1, at first, the clad plate is prepared by laminating the metallic plate to be used as the electric conductive member 3 and the metallic plate to be used as the spring member 4 by way of flat rolling and bonding. A plurality of long rectangle holes is formed at a regular interval by applying punching work to the clad plate. The electric contact 1 is finally obtained by rolling the clad plate in the form of the approximately cylindrical shape.

The electric conductive member 3 is composed of the material having a higher electric conductivity such as copper and copper alloy. The material used for the electric conductive member 3 has preferably such an electric conductivity as 60% or larger IACS. In this embodiment, copper (for example, C1020, C1100 and the like) with 0.3 mm thickness is used for the electric conductive member 3.

The spring member 4 is composed of the material having relevant spring elasticity such as stainless steel, phosphor bronze, beryllium copper and Corson alloy. As for the spring member 4, the materials with 0.2% yield strength being 600Mpa or higher may be preferably used. In this embodiment, stainless steel (for example, SUS304, SUS301 and the like) with 0.1 mm thickness is used for the spring member 4. Copper, brass or copper alloy with its electric conductivity being 60% or larger IACS is used for the female contact maker 11 and the male contact maker 12.

In forming the contact member 2 in an approximately cylindrical shape, it is allowed that either of the electric conductive member 3 and the spring member 4 is rolled on the inward or outward side. Metal plating with Sn, Ag, Au and the like is applied to the top surface of the contact member 2 in order to secure the stable contact resistance to the female contact maker 11 and the male contact maker 12.

As shown in FIG. 1 and FIG. 4, the female terminal in this embodiment has a female contact maker 11 and an electric contact 1.

Now, the operation of this embodiment is described below.

The electric contact 1 is arranged inside the female contact maker 11, and the male contact maker 12 is inserted into the inside circumference of the electric contact 1, then the female contact maker 11 and the male contact maker 12 are electrically connected to each other by means that the female contact maker 11 comes in contact with the electric conductive member 3, and that the male contact maker 12 comes in contact with the spring member 4.

In the electric contact 1, by means of using the composite material composed of the material having relevant spring elasticity such as stainless steel, phosphor bronze, beryllium copper and Corson alloy, and the material having higher electric conductivity such as copper and copper alloy, the spring elasticity characteristic and the electric conductivity characteristic can be controlled individually which cannot be attained by using a single material. As a result, more stable electrical connection can be secured with the reduced contact resistance between the male contact maker 12 and the female contact maker 11 even by applying the strong force between the male contact maker 12 and the female contact maker 11.

In addition, as the electric contact 1 having the thickness identical to the conventional one can provide the reduced electrical resistance of the electric contact 1, the heat generation by the electric contact itself can be decreased, which can carry the higher current.

In case of assuming that the current identical to the conventional one is assumed to be carried into the electric contact 1, the size of the electric contact 1 and the female terminal can be reduced.

And furthermore, by means of modifying the thickness of the spring member 4 without changing the thickness of the electric conductive member 3, the spring elasticity of the electric contact 1 can be controller relevantly.

By controlling the spring elasticity, the insertion force for engaging the male contact maker 12 and the female contact maker 11 can be changed. By controlling the spring elasticity, the contact resistance between the male contact maker 12 and the female contact maker 11 can be changed, which can establish the spring force setting for assuring the stable electric contact.

By increasing the thickness of the electric conductive member without changing the thickness of the spring member 4, the electric current to be carried can be increased and the allowable current for the electric contact 1 itself can be increased.

As an alternative embodiment to the above-described embodiment in which the composite member is formed by laminating the electric conductive member 3 formed in a plate and the spring member 4 formed in a plate, it is allowed that the both surfaces of the spring member 4 formed in a plate are laminated by the electric conductive member 3 formed in a plate in order to form the composite member, and the contact member is finished by forming the composite member into an approximately cylindrical shape. In this case, the same effect as described above can be obtained.

Next, another embodiment of the present invention is described by referring to the accompanied drawings.

Figure 6:
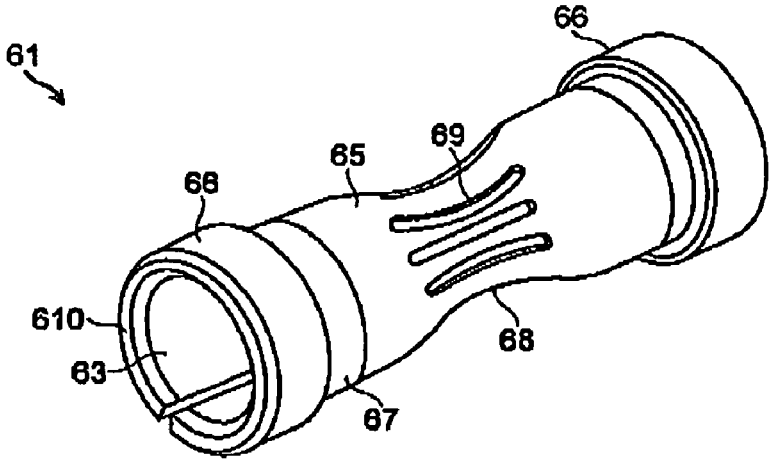
FIG. 6 is a perspective view of the electric contact in another embodiment of the present invention.
Figure 7:
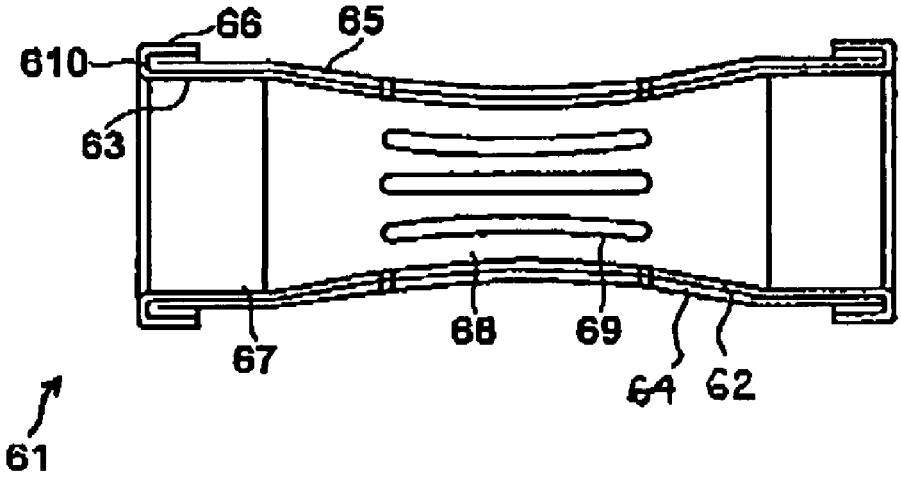
FIG. 7 is a side cross-section view of the electric contact shown in FIG. 6.

As shown in FIG. 6 and FIG. 7, in the electric contact 61 according to the present invention, the electric conductive member 62 is used as the inside wall 63 and the spring member 64 is used as the outside wall 65, the outside contact section 66 is formed so as to comprise the electric conductive member 62 which connects to the inside wall 63 and locate outside the outside wall 65.

The electric contact 61 has an approximately cylindrical shape comprising a straight tube section 67 with its outer diameter being constant at a designated portion from both ends in the longitudinal direction and the outer diameter of the straight tube section 67 is larger than the outer diameter at the center section 68 in the longitudinal direction. The center section 68 has a neck shape. Slits 69, each shaped in a long rectangle or an ellipse, are formed at the center section 68.

As the outside contact section 66 is used for contacting directly to the female contact maker as described later, its diameter is the largest among the diameter of the sections of the electric contact 61. Though it is allowed that the outside contact section 66 may be formed at any location in the longitudinal direction in the electric contact 61, the outside contact section 66 is formed the outside circumference of the end part of the outside wall 65.

The outside contact section 66 is formed by folding back the end part of the inside wall 63 toward outside the end part of the outside wall 65, and therefore, the outside contact section 66 and the inside wall 63 are formed with a continuously integrated body of the electric conductive member 62. It is allowed that the outside contact section 66 and the inside wall 63 may be formed with individually separated bodies of the electric conductive member 62 as long as the outside contact section 66 and the inside wall 63 are connected electrically.

And furthermore, in this embodiment, the outside contact member 66 is formed by folding back both end parts of the inside wall 63 toward outside the individual end parts of the outside wall 3.

At the outside contact section 66 of this embodiment, the end part of the inside wall 63 and the end part of the outside wall 65 are aligned to each other and the end part of the inside wall 63, and the end part of the inside wall 63 and the end part of the outside wall 65 are folded back toward outside. Owing to this structure, the spring member 64 formed as the outside wall 65 is folded back and laminated together with the spring member 64 itself, and the electric conductive member 62 of the inside wall 63 forms the end face 610 so as to cover the spring member 64, and extends to the outside contact section 66. It is allowed that the end part of the inside wall 63 may be formed in an extended length so as to extend over the end part of the outside wall 65 and that its extended part may be folded back toward outside the end part of the outside wall 65.

The electric conductive member 62 is composed of, for example, copper and copper alloy. The spring member 64 is composed of, for example, stainless steel, phosphor bronze and beryllium. As for the electric contact 61, the composite member (clad member; refer to FIG. 2) 5 which is composed of the spring member 64 composed of copper alloy or stainless steel with good spring elasticity but with its electric conductivity being 50% or smaller IACS and the electric conductive member 62 composed of copper or copper alloy with higher electric conductivity being 80% or larger IACS is used.

In applying the clad member 5 to the electric contact 61, both ends in the width direction of the clad member 5 to be formed as the end parts of the electric contact 61 are folded back in order to form the outside contact section 66 so that the Spring member may be folded back inward, and then the clad member 5 is rolled in the form of cylinder so that the outside contact section 66 may be exposed outside, and a neck section is formed at the center section 68.

Metal plating with Sn, Ag, Au and the like is applied to the surface of the electric contact 61 in order to secure stable contact resistance.

Figure 8:
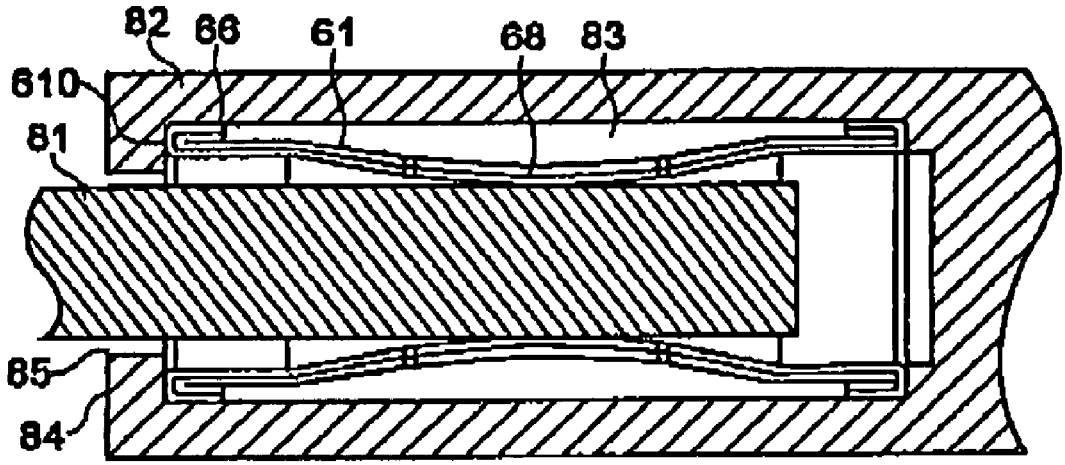
FIG. 8 is a side cross-section view of the installation configuration of the electric contact shown in FIG. 6.

FIG. 8 shows a usage configuration of the electric contact 61. The male contact maker 81 is a round rod having a constant diameter in the longitudinal direction. The diameter of the male contact maker 81 is so determined as to be slightly larger than the internal diameter of the neck part of the center section 68 of the electric contact 61 in the longitudinal direction. As shown in FIG. 1 in which the male contact maker 81 is inserted into the electric contact 61, the inside circumference of the inside wall 63 of the electric contact 61 contacts to the outside circumference of the male contact maker 81 at the center section 68 in the longitudinal direction of the electric contact 61.

The female contact maker 82 is shaped in a cylinder with its diameter larger enough than the diameter of the male contact maker 81 so as to accommodate the electric contact 61 inside itself. In other words, the female contact maker 82 has a contact housing space 83 formed in a cylindrical shape with its inside diameter being almost equal to the outside diameter of the outside contact section 66 which defines the maximum diameter of the electric contact 61. The open part 85, which is enclosed by the edge wall 84 and has an aperture having a diameter lightly larger than the diameter of the male contact maker 81, is formed at one end of the female contact maker 82, and the open part 85 connects to the contact housing space 83.

The depth of the contact housing space 83 is almost the same as the length of the electric contact 61. For the electric contact 61, which is accommodated in the contact housing space 83 shaped in a cylinder, the outside circumference of the outside contact section 66 contacts the inside circumference of the female contact maker 82 in the radial direction, and one end face 610 contacts the inside face of the edge wall 84 in the longitudinal direction as well as the other end face 610 contacts the end wall of the contact housing space 83.

The female terminal is composed of the electric contact 61 accommodated in the contact housing space 83 of the female contact maker 82.

Next, the operation effect of the electric contact 61 shown in FIG. 6 and FIG. 7 is described by referring to FIG. 8.

When the electric contact 61 contacts the female contact maker 82, the components comprising the electric conductive member 62 (the outside contact section 66 and the end face 610) contacts the female contact maker 82. When the electric contact 61 contacts the male contact maker 81, the components comprising the electric conductive member 62 (the neck part of the center section 68 of the inside wall 63) contacts to the male contact maker 82. The components from the outside contact section 66 through the inside wall 63 are formed with a continuously integrated body of the electric conductive member 62.

Thus, the current path from the male contact maker 82 to the female contact maker 81 includes the outside contact section 66, the end face 610 and the inside wall 63. As the current path only includes the electric conductive member 62 with high electric conductivity and excludes the spring member 64 with low electric conductivity, the overall electric conductivity of the electric contact 61 is high.

As the components from the outside contact section 66 through the inside wall 63 are formed with a continuously integrated body of the electric conductive member 62, there is no junction point and no contact resistance. Therefore, the overall electric conductivity of the electric contact 61 is high. Thus, even though the spring member 64 is included in the components, as the current path is entirely composed of the electric conductive member 62, and the electric conductive member 62 extending to the inside wall 63 includes the outside contact section 66 existing outside the outside wall 65 in the electric contact 61 according to the present invention, high electric conductivity can be obtained.

As the overall electric conductivity of the electric contact 61 is high, it will be appreciated that the heat generation in the electric contact 61 can be reduced. Therefore, the current-carrying capacity can be increased and higher current can be carried in comparison with the conventional electric contact as well as the size of the electric contact can be reduced.

Even though the thickness of the spring member 64 is made larger in order to enhance the press force in the electric contact 61 according to the present invention, the overall electric conductivity of the electric contact 61 does not change substantially because the current path is formed by the components composed of the electric conductive member 62 and there is very short current path inside the outside wall 65 composed of the spring member 64 in its thickness direction. This means that the overall electric conductivity of the electric contact 61 is substantially determined independently of the thickness of the spring member 64.

In the electric contact 61 according to the present invention, the overall current-carrying capacity of the electric contact 61 becomes large if the thickness of the electric conductive member 62 is increased in order to increase the current-carrying capacity. This means that the overall electric conductivity of the electric contact 61 is substantially determined independently of the thickness of the spring member 64.

In the electric contact 61 according to the present invention, the overall current-carrying capacity of the electric contact 61 can be changed by means of selecting the electric conductive member 62 to be another electric conductive material having a different electric conductivity. In this case, the overall electric conductivity of the electric contact 61 is substantially determined independently of the electric conductivity and thickness of the spring member 64.

In the above embodiments, as the outside contact section 66 is formed by folding back the end part of the inside wall 63 toward outside the end part of the outside wall 65, it will be appreciated that the outside contact section 66 can be provided without adding another member, and that the fabrication steps can be simplified, for example, because the outside contact section 66 is formed by folding back the clad member 5 formed in a plate in advance and then rolling the clad member 5 into a cylindrical shape.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

The invention claimed is:

1. An electric contact arranged inside a female contact maker of a female terminal, wherein the electric contact is formed by a clad composite member comprising a laminate of an electric conductive member and a spring member, the laminate being formed into a substantially cylindrical shape such that the electric conductive member becomes an inner side of the substantially cylindrical shape and the spring member becomes the outer side of the substantially cylindrical shape, and ends of the substantially cylindrical shape are folded back to form folded portions at which the electric conductive member is disposed on an outer side of the folded portions.

2. The electric contact according to claim 1, wherein said electric conductive member is composed of copper or copper base alloy, and said spring member is composed of stainless steel, phosphor bronze, beryllium copper or Corson alloy.

3. A female terminal, wherein a female contact maker having an open part for inserting a male contact maker and a contact housing space for connecting to the open part is formed, and the electric contact according to claim 1 is accommodated inside said contact housing space of said female contact maker.

4. An electric contact for arrangement in a female contact maker, comprising:

a tubular member having a substantially cylindrical shape and having an inside wall made from an electrically conductive member and an outside wall made of a spring member, the tubular member comprising at least one straight tube section provided at at least one end and having a constant outer diameter at a designated portion spaced from the at least one end and a center section having a neck shape such that the outer diameter of the at least one straight tube section is greater than an outer diameter of portions of the center section;

at least one contact section provided at the at least one end of the tubular member, the at least one contact section comprising an end portion of the electrically conductive member folded over radially outside the spring member such that the contact section has a larger diameter than the diameter of the at least one straight tube section at the designated portion thereof.

5. The electric contact according to claim 4, wherein the tubular member comprises a pair of the straight tube sections, one provided at each end of the tubular member.

6. The electric contact according to claim 5, wherein a pair of contact sections are provided, one at each end of the tubular member.

7. The electric contact according to claim 6, wherein the electrically conductive member has a length greater than the spring member such that both end portions of the electrically conductive member extend past ends of the spring member and are folded over radially outside the end of the spring member.

8. A female terminal, comprising a female contact maker having an open part for inserting a male contact maker and a contact housing space for connecting to the open part, and the electric contact according to claim 7 is accommodated inside the contact housing space of the female contact maker.

9. A female terminal, comprising a female contact maker having an open part for inserting a male contact maker and a contact housing space for connecting to the open part, and the electric contact according to claim 5 is accommodated inside the contact housing space of the female contact maker.

10. A female terminal, comprising a female contact maker having an open part for inserting a male contact maker and a contact housing space for connecting to the open part, and the electric contact according to claim 6 is accommodated inside the contact housing space of the female contact maker.

11. The electric contact according to claim 4, wherein the electrically conductive member is composed of copper or a copper base alloy, and the spring member is composed of stainless steel, phosphor bronze, beryllium copper or Corson alloy.

12. A female terminal, comprising a female contact maker having an open part for inserting a male contact maker and a contact housing space for connecting to the open part, and the electric contact according to claim 11 is accommodated inside the contact housing space of the female contact maker.

13. The electric contact according to claim 4, wherein the center section of the tubular member has a plurality of slits formed therein.

14. The electric contact according to claim 13, wherein each of the plurality of slits has a rectangular or elliptical shape and a longitudinal axis parallel to a longitudinal axis of the tubular member.

15. A female terminal, comprising a female contact maker having an open part for inserting a male contact maker and a contact housing space for connecting to the open part, and the electric contact according to claim 14 is accommodated inside the contact housing space of the female contact maker.

16. The electric contact according to claim 4, wherein the electrically conductive member has a length greater than the spring member such that at least the end portion of the electrically conductive member extends past an end of the spring member and is folded over radially outside the end of the spring member.

17. A female terminal, comprising a female contact maker having an open part for inserting a male contact maker and a contact housing space for connecting to the open part, and the electric contact according to claim 16 is accommodated inside the contact housing space of the female contact maker.

18. A female terminal, comprising a female contact maker having an open part for inserting a male contact maker and a contact housing space for connecting to the open part, and the electric contact according to claim 4 is accommodated inside the contact housing space of the female contact maker.

* * * * *